US007699427B2

(12) United States Patent
Asauchi

(10) Patent No.: US 7,699,427 B2
(45) **Date of Patent: *Apr. 20, 2010**

(54) DETECTION OF A PRINT RECORDING MATERIAL RESERVOIR

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 706 days.

This patent is subject to a terminal disclaimer.

(21) Appl. No.: 11/582,082

(22) Filed: Oct. 16, 2006

(65) Prior Publication Data

US 2007/0035571 A1 Feb. 15, 2007

Related U.S. Application Data

(63) Continuation of application No. 10/731,367, filed on Dec. 8, 2003, now Pat. No. 7,137,682, which is a continuation of application No. 10/174,287, filed on Jun. 12, 2002, now Pat. No. 6,666,540.

(30) Foreign Application Priority Data

Jun. 19, 2001 (JP) ..... 2001-184446

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 5,719,686 A * 2/1998 Sakamoto et al. ..... 358/444
6,065,831 A * 5/2000 Kawaura et al. ..... 347/108
6,616,260 B2 * 9/2003 Skene et al. ..... 347/19

FOREIGN PATENT DOCUMENTS

JP 04-049142 8/1992
JP 2001-105699 4/2001

OTHER PUBLICATIONS

Abstract of Japanese Patent Publication No. 58-192154, Pub. Date: Nov. 9, 1983, Patent Abstracts of Japan.
Abstract of Japanese Patent Publication No. 2001-105699, Pub. Date: Apr. 17, 2001, Patent Abstracts of Japan.

* cited by examiner

*Primary Examiner*—Julian D Huffman
(74) *Attorney, Agent, or Firm*—Martine Penilla & Gencarella, LLP

(57) ABSTRACT

Control circuit 30 determines whether or not all ink cartridges CA1 through CA6 are attached in the home position based on cartridge out signals COO. Control circuit 30 carries out communication with memory devices 21 through 26 and determines the presence or absence of communication malfunctions. When a communication malfunction develops in one of memory devices 21 through 26, control circuit 30 determines if a communication malfunction is caused by ink cartridge 30 being detached and identifies detached ink cartridge CA using identifying information. When all of ink cartridges CA1 through CA6 are attached, control circuit 30 determines which of memory devices 21 through 26 has developed a communication malfunction and identifies ink cartridge CA in which a communication malfunction has developed using identifying information.

1 Claim, 5 Drawing Sheets

DETECTION OF A PRINT RECORDING MATERIAL RESERVOIR

CROSS-REFERENCE TO RELATED APPLICATION

This application is a continuation of U.S. application Ser. No. 10/731,367, filed Dec. 8, 2003 now U.S. Pat No. 7,137, 682, which is a continuation of U.S. application Ser. No. 10/174,287, filed Jun. 12, 2002 (now U.S. Pat. No. 6,666,540 B2), the disclosures of which are incorporated herein by reference.

FIELD OF THE INVENTION

The present invention relates to a technique for detecting the presence of a print recording medium reservoir when a plurality of print recording medium reservoirs equipped with bus-connected memory device is used.

BACKGROUND OF THE INVENTION

Print recording material reservoirs equipped with memory devices, such as ink cartridges, have come to be used. In the memory device are stored, for example, data relating to the amount of printing/recording medium ("ink"), data relating to the type of ink, and information as to the year and date the ink cartridge was manufactured. In color printers, ordinarily at least four colors of ink are used, namely cyan ink, magenta ink, yellow ink, and black ink. Accordingly, a printer is equipped either with two ink cartridges, namely a black ink cartridge and a color ink cartridge, or with four ink cartridges, with one cartridge being for each color.

Further, to reduce the number of signal lines connecting each memory device provided on an ink cartridge with a control circuit, a technique is known whereby the signal line that identifies each memory device is eliminated, and a bus connection is used in which each memory device is connected using a common bus. With this technique, an identifying figure that has been uniquely assigned to each memory device is used to specify (identify) each bus-connected memory device.

However, with the bus connection format, the problem arises that, although the removal of an ink cartridge can be detected, when a plurality of ink cartridges are removed at the same time, it is impossible to identify which ink cartridge has been removed. Moreover, when communication between each memory device provided on an ink cartridge and the control circuit of the printer does not occur correctly, it cannot be ascertained in which memory device (ink cartridge) a malfunction has developed; the user must detach all of the ink cartridges to confirm their operation.

SUMMARY OF THE INVENTION

The present invention is intended to solve the aforementioned problems, and has the aim of detecting communication malfunctions that have developed in a print recording material reservoir, and obtaining information regarding such malfunctions, in the case of a printing device equipped with a plurality of print recording material reservoirs equipped with bus-connected memory devices. Another object of the present invention is to detect which print recording material reservoir is not present. A further object of the present invention is to detect in which memory device with which a print recording material reservoir has been equipped has a malfunction when communication between a memory device and a printing device does not occur correctly.

In the first aspect of the present invention intended to solve the problems, a malfunction detecting device for print recording material reservoirs equipped with a memory device that stores identifying information is provided. The malfunction detecting device of the first aspect of the present invention comprises signal lines that connect via bus connection each of the memory devices with which the plurality of print recording material reservoirs are equipped; a communication determining unit that determines whether communication is possible with all the memory devices with which the print recording material reservoirs are equipped, via the signal lines; and a malfunctioning print recording material reservoir identifying unit that identifies the print recording material reservoir equipped with a memory device in which a communication malfunction has developed, based on the identifying information, when the communication determining unit determines that communication is not possible with all of the memory devices.

With the first aspect of the present invention, it is determined whether communication is possible with memory devices with which a plurality of print recording material reservoirs are equipped. When a communication malfunction has developed, the print recording material reservoir equipped with a memory device in which a communication malfunction has developed is specified using identifying information. As a result, when a printing device has a plurality of print recording material reservoirs equipped with bus-connected memory devices, it is possible to detect in which print recording material reservoir a communication malfunction has developed. Here, determining the print recording material reservoir equipped with a memory device in which a communication malfunction has developed can readily be accomplished, for example, by transmitting identifying information to memory devices, and basing the determination on whether or not the memory devices to which identifying information has been transmitted respond. Alternatively, identifying information stored by memory devices may be detected, and the determination based on whether or not the expected identifying information exists.

The malfunction detecting device of the first aspect of the present invention may also comprise an attachment determining unit determining whether the print recording material reservoirs are attached when the plurality of print recording material reservoirs have been moved to a position in which the print recording material reservoirs cannot be removed; and a communication malfunction reason determining unit determining whether a communication malfunction has been caused by a print recording material reservoir not being attached, when it is determined that the print recording material reservoir is not attached.

In this case, by providing a structure in which detachment of print recording material reservoirs is not permitted, it is possible to detect with certainty the existence of print recording material reservoirs, and it is also possible to ascertain whether the reason for a communication malfunction lies in an attachment failure of a print recording material reservoir.

In the malfunction detecting device of the first aspect of the present invention, when it is determined that the print recording material reservoir is not attached, the communication malfunction reason determining unit may also determine that the cause of the communication malfunction lies in a communication malfunction arising in a memory device with which the print recording material reservoir has been equipped. In such a case, it can be determined that the reason for a communication malfunction that has arisen even though the print recording material reservoirs are attached lies in a communication malfunction occurring in a memory device with which a print recording material reservoir has been equipped.

In the malfunction detecting device of the first aspect of the present invention, the communication determining unit may also determine whether or not communication is possible with all of the memory devices with which the print recording material reservoirs have been equipped, when the plurality of print recording material reservoirs have been moved to a position in which the print recording material reservoirs cannot be removed. In such a case, because the print recording material reservoirs cannot freely be detached, communication malfunctions can be determined with more certainty.

In the malfunction detecting device of the first aspect of the present invention, the malfunctioning print recording material reservoir identifying unit may also retrieve identifying information for each of the plurality of print recording material reservoirs successively, and identify the print recording material reservoir that has a memory device in which identifying information is stored that cannot be detected as the print recording material reservoir in which the communication malfunction has arisen.

In the malfunction detecting device of the first aspect of the present invention, the identifying information may also be information relating to the print recording material contained in the print recording material reservoir. In such a case, the information relating to the print recording medium can be used to implement printing management.

In a second aspect of the present invention, a notifying device that provides notification of a communication malfunction arising in a print recording material reservoir equipped with a memory device is provided. The notifying device of the second aspect of the present invention comprises a communication malfunction detecting unit that detects a communication malfunction with a memory device with which a print recording material reservoir is equipped, a print recording material reservoir identifying unit that identifies the print recording material reservoir equipped with a memory device in which a communication malfunction has arisen, and a notifying unit that notifies of the identified print recording material reservoir.

With the use of the notifying device of the second aspect of the present invention, the user can be notified of which print recording material reservoir has developed a communication malfunction. Accordingly, the user can very easily identify a print recording material reservoir in which a communication malfunction has developed.

The notifying device of the second aspect of the present invention, moreover, may also comprise a communication malfunction reason determining unit, which determines whether the cause of the communication malfunction is that one of the print recording material reservoirs is not attached, or that the cause lies in a memory device with which a print recording material reservoir is equipped; the notifying unit may provide notification of the identified print recording material reservoir through the condition of a notification that differs according to the reason for the communication malfunction. In such a case, the user can clearly be notified of a detached print recording material reservoir or of a print recording material reservoir equipped with a memory device in which a communication malfunction has developed. Accordingly, on reattachment, it is possible to prevent a print recording material reservoir from being attached that contains a print recording material differing from that in the detached print recording material reservoir. Moreover, because a print recording material reservoir with a communication malfunction can be identified at a glance, the communication malfunction can readily be corrected.

With the notifying device of the second aspect of the present invention, the different notification conditions can comprise notification by means of a display lamp, notification by means of a display image, and notification by means of a sound.

With the notifying device of the second aspect of the present invention, memory devices with which print recording material reservoirs are equipped are connected through a shared bus connection, and individual identifying information is stored in the memory devices. The print recording material reservoir identifying unit may also identify a print recording material reservoir equipped with a memory device in which a communication malfunction has developed based on the identifying information. In a device with such a structure, the same operative effect can be obtained as with the malfunction detecting device of the first aspect of the present invention.

In a third aspect of the present invention, a printing device is provided with a plurality of print recording material reservoirs equipped with memory devices in which identifying information is stored attached. The printing device of the third embodiment of the present invention is equipped with: signal lines connecting via bus-connection each memory device with which the plurality of print recording material reservoirs is equipped; a replacement request detecting unit that detects a replacement request in the print recording material reservoir; a replacement completion detecting unit that detects completion of replacement of the print recording material reservoir; an attachment determining unit that determines whether or not the plurality of print recording material reservoirs are all attached; a communication determining unit that determines whether or not communication is possible with each of the memory devices via the signal lines when the plurality of print recording material reservoirs are all determined to be attached; and a first print recording material reservoir identifying unit that identifies a print recording material reservoir equipped with a memory device with which communication is not possible based on the identifying information, when it is determined that communication is not possible with each of the memory device.

With the printing device of the third embodiment of the present invention, when the plurality of print recording material reservoirs are all attached, it is determined whether or not communication is possible with each of the memory devices via signal lines; when it is determined that communication is not possible with each of the memory devices, the print recording material reservoir equipped with a memory device with which communication is not possible is identified based on identifying information. As a result, which memory device with which a print recording material reservoir is equipped has developed a malfunction can be detected. Further, by providing a structure in which notification is conducted as to a print recording material reservoir in which correct communication cannot be achieved, a user does not have to repeat the detaching of all of the print recording material reservoirs, but can identify at a glance the print recording material reservoir with which communication cannot take place correctly.

Further, with the printing device of the third embodiment of the present invention, a print recording material data acquiring unit may be provided which acquires data relating to a print recording material from each of the memory devices when it is determined that communication is possible with each of the memory devices. In such a case, it is possible to acquire correct print recording material data from each of the memory devices.

Further, with the printing device of the third embodiment of the present invention, when it is determined that not all of the plurality of print recording material reservoirs are attached, a second print recording material reservoir identifying unit may be provided to communicate with each of the memory devices via the signal lines, and identify a detached print recording material reservoir based on the identifying information. In such a case, it is possible to detect which print recording material reservoir is not attached when a plurality of print recording material reservoirs equipped with bus-connected memory devices are attached to a printing device.

Further, with the printing device of the third embodiment of the present invention, it is also acceptable that said printing device may be equipped with: a first moving unit that moves the print recording material reservoirs into the replacement position, when a replacement request is detected for the print recording material reservoir by means of the replacement request detecting unit; and a second moving unit that moves the print recording material reservoirs into the attachment determining position where attachment determination is performed on the print recording material reservoirs by means of the attachment determining unit, when the completion of replacement of the print recording material reservoirs has been detected by the replacement completion detecting unit.

In such a case, for example, by providing a structure in which detachment of the print recording material reservoirs is not permitted at the attachment determining position, the presence or absence of print recording material reservoirs can be detected with certainty.

In a fourth embodiment of the present invention, a method of detecting whether or not print recording material reservoirs are attached is provided, in a printing device in which a plurality of print recording material reservoirs equipped with memory devices that are bus-connected and that store identifying information. With the method of the fourth embodiment of the present invention, a determination is made whether or not a replacement request for the print recording material reservoirs has been generated; when a determination has been made that a replacement request for the print recording material reservoirs has been generated, a determination is made whether or not replacement of the print recording material reservoirs has been completed; when a determination has been made that replacement of the print recording material reservoirs has been completed, a determination is made whether or not each of the print recording material reservoirs is attached; when a determination has been made that one of the print recording material reservoirs is not attached, the detached print recording material reservoir is identified using the identifying information.

Using the method of the fourth embodiment of the present invention, when a plurality of print recording material reservoirs equipped with bus-connected memory devices are attached to a printing device, which print recording material reservoir is not attached can be detected using identifying information.

With the method of the fourth embodiment of the present invention, it is also acceptable that: when a determination has been made that all of the print recording material reservoirs are attached, a determination is made whether or not communication is possible with each of the memory devices; when a determination has been made that communication is possible with each of the memory devices, information stored in the memory devices relating to the print recording material is obtained. In such a case, because communication with each of the memory devices occurs correctly, information relating to the print recording medium can be acquired with certainty.

With the method of the fourth embodiment of the present invention, it is also acceptable that: when a determination has been made that communication is impossible with one of the memory devices, the print recording material reservoir equipped with a memory device with which communication is impossible can be identified using the identifying information. In such a case, a print recording material reservoir equipped with a memory device with which communication cannot occur correctly can be detected. Further, by providing a structure in which notification is made of a print recording material reservoir with which communication cannot occur correctly, a user does not have to repeat the detaching of all of the print recording material reservoirs, but can identify at a glance the print recording material reservoir with which communication cannot take place correctly.

In a fifth embodiment of the present invention, a print recording material reservoir detecting device is provided that is appropriate for use with a printing device in which a plurality of print recording material reservoirs equipped with memory devices that store identifying information are attached. The print recording material reservoir detecting device of the fifth embodiment of the present invention is equipped with signal lines connecting via bus connection each of the memory devices with which the plurality of print recording material reservoirs is equipped; a selecting unit that selects a print recording material reservoir to be replaced from among the plurality of print recording material reservoirs; a first moving unit that moves the selected print recording material reservoir to a replacement position where replacement of the print recording material reservoir is permitted; a replacement completion detecting unit that detects when replacement of the print recording material reservoir has been completed; a second moving unit that moves all of the print recording material reservoirs to an attachment determining position where removal is physically impossible, when it is detected that replacement of the print recording material reservoirs has been completed; an attachment determining unit that determines whether or not all of the print recording material reservoirs are attached at the attachment determining position; a communication determining unit that determines whether or not communication with each of the memory devices is possible via the signal lines, when it is determined that all of the plurality of print recording material reservoirs are attached; and a first print recording material reservoir identifying unit that identifies a print recording material reservoir equipped with a memory device with which communication is impossible based on the identifying information, when it is determined that communication is not possible with all of the memory devices.

With the print recording material reservoir detecting device of the fifth embodiment of the present invention, because all of the print recording material reservoirs are moved to an attachment determining position where removal is physically impossible, and it is then determined whether the print recording material reservoirs are attached, a more certain determination can be made as to whether the print recording material reservoirs are attached.

Further, with the print recording material reservoir detecting device of the fifth embodiment of the present invention, it is also acceptable that: a second print recording material reservoir identifying unit is provided that communicates with each of the memory devices via the signal lines and identifies a detached print recording material reservoir based on the identifying information, when it is determined that not all of the plurality of print recording material reservoirs are attached. In such a case, a detached print recording material reservoir can be detected in a simple manner using identifying information.

These and other advantages of the present invention will become apparent upon reading the following detailed descriptions and studying the various figures of the drawings.

BRIEF DESCRIPTION OF THE DRAWINGS

The invention, together with further advantages thereof, may best be understood by reference to the following description taken in conjunction with the accompanying drawings which.

DETAILED DESCRIPTION OF THE PREFERRED EMBODIMENTS

Below, the print recording material reservoir malfunction detecting device of the present invention is described based on embodiments thereof, with reference to figures.

Figure 1:
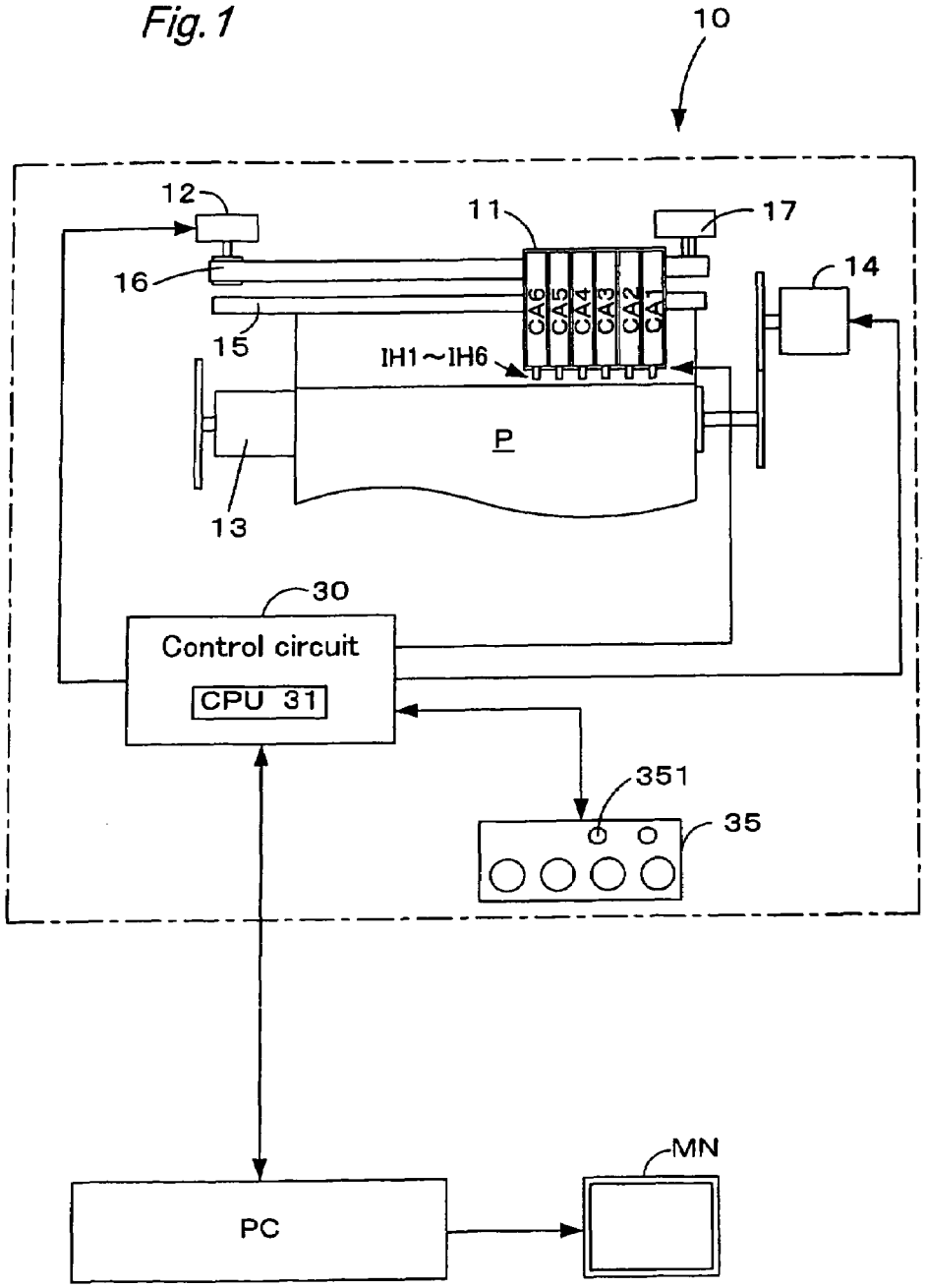
FIG. 1 is a descriptive diagram showing, in simplified form, the internal structure of a printing device for which the print recording material reservoir malfunction detecting device of the present embodiment can appropriately be used.

The internal composition of a printing device in which a print recording material reservoir malfunction detecting device of the present invention can appropriately be employed is described with reference to FIG. 1. FIG. 1 is a descriptive diagram showing a summary of the internal composition of a printing device in which a print recording material reservoir malfunction detecting device of the present invention can appropriately be employed is shown.

The print recording material reservoir malfunction detecting device of the present invention can appropriately be employed in inkjet-type printer (printing device) 10. Color printer 10 is a printer with which color display output is possible; for example, an inkjet-type printer in which color inks of six colors, namely cyan (C), light cyan (LC), magenta (M), light magenta (LM), yellow (Y), and black (K) form an image by forming a dot pattern on a printing medium (for example, paper for printing). Although the present invention is described in the present embodiment using an inkjet-type color printer, an electrophotographic-type printer, in which color toner is transferred onto and fused to a printer medium is also acceptable.

As shown in the diagram, color printer 10 comprises a mechanism in which ink is discharged and dots are expressed when print heads IH1 through IH6, which are loaded on carriage 11, are operated; a mechanism to reciprocally move the carriage 11 along the axial direction of platen 13 by carriage motor 12; a mechanism that conveys paper sheet P for printing by means of paper conveying motor 14; and control circuit 30. The mechanism to move the carriage 11 reciprocally along the axial direction of platen 13 comprises friction drive axle 15 that keeps carriage 11, which is supported parallel to the axis of platen 13, able to be moved by friction; and pulley 17 or the like connected to endless drive belt 16 stretched to carriage motor 12. To begin replacement of ink cartridge CA, color printer 10 is equipped with operation buttons to input each type of command to printer 10 and operating panel 35 equipped with display lamp 351.

Control circuit 30 functions as a malfunction detecting device for a print recording material reservoir (ink cartridge) in printer 10, and also, while exchanging signals with operating panel 35 of printer 10, controls the movement of paper conveying motor paper conveying motor 14, carriage motor 12, and print heads IH1 through IH6 as appropriate. Ink cartridges CA1 through CA6 are attached to carriage 11. For example, ink cartridge CA1 contains black (K) ink, ink cartridge CA2 contains cyan (C) ink cartridge CA3 contains light cyan (LC) ink, ink cartridge CA4 contains magenta (M) ink, ink cartridge CA5 contains light magenta (LM) ink, and ink cartridge CA6 contains yellow (Y) ink.

Paper P for printing that is supplied to color printer 10 is set so as to be pressed between paper platen 13 and a paper supply assisting roller, and only the required amount is advanced according to the rotational speed of platen 13. Control circuit 30, in accord with internally provided CPU 31, in addition to functioning as a malfunction detecting device for ink cartridges CA in color printer 10 as described above, carries out data reading and writing operations on memory devices 21 through 26 with which ink cartridges CA1 through CA6 are equipped, based on control signals from personal computer PC. Further, in the present embodiment, control circuit 30 controls the internal operations of printer 10 according to print control signals received from personal computer PC, and carries out printing operations.

Figure 2:
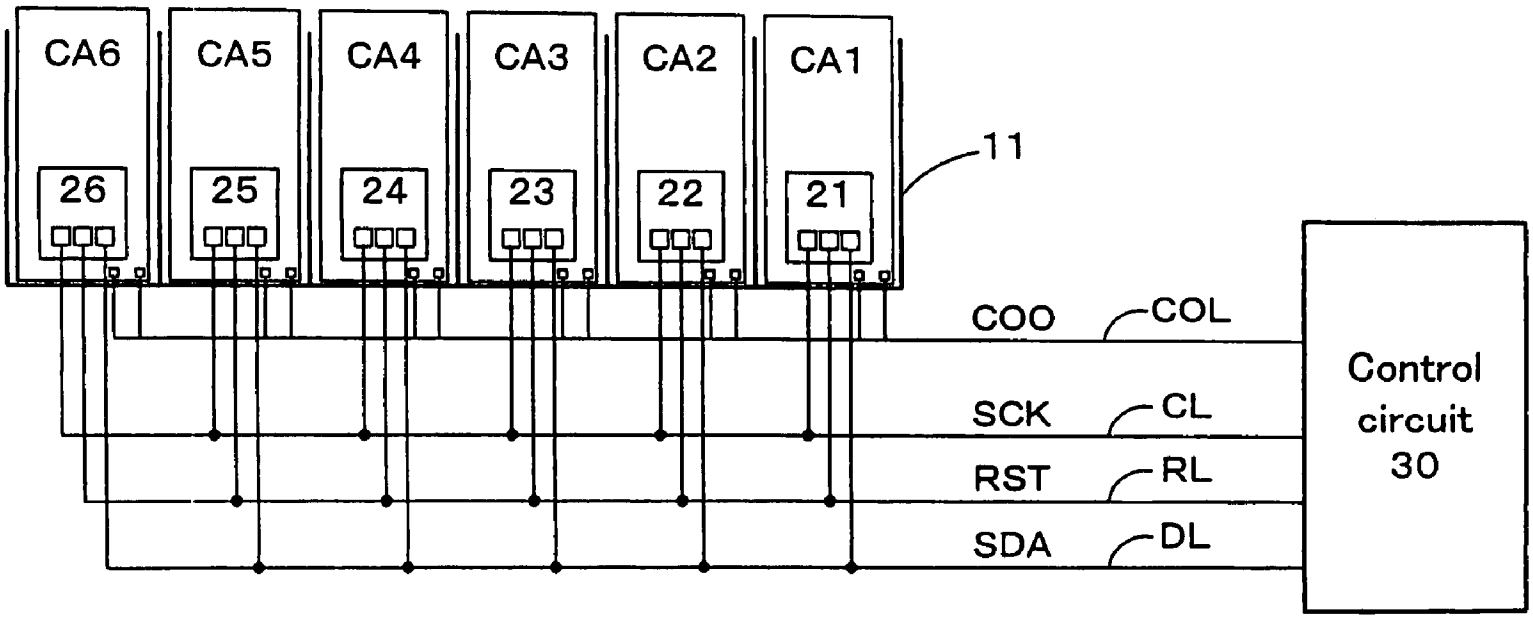
FIG. 2 is a descriptive diagram showing, in simplified form, the connection status between ink cartridges CA1 through CA6 attached on carriage 11 and a control circuit.
Figure 3:
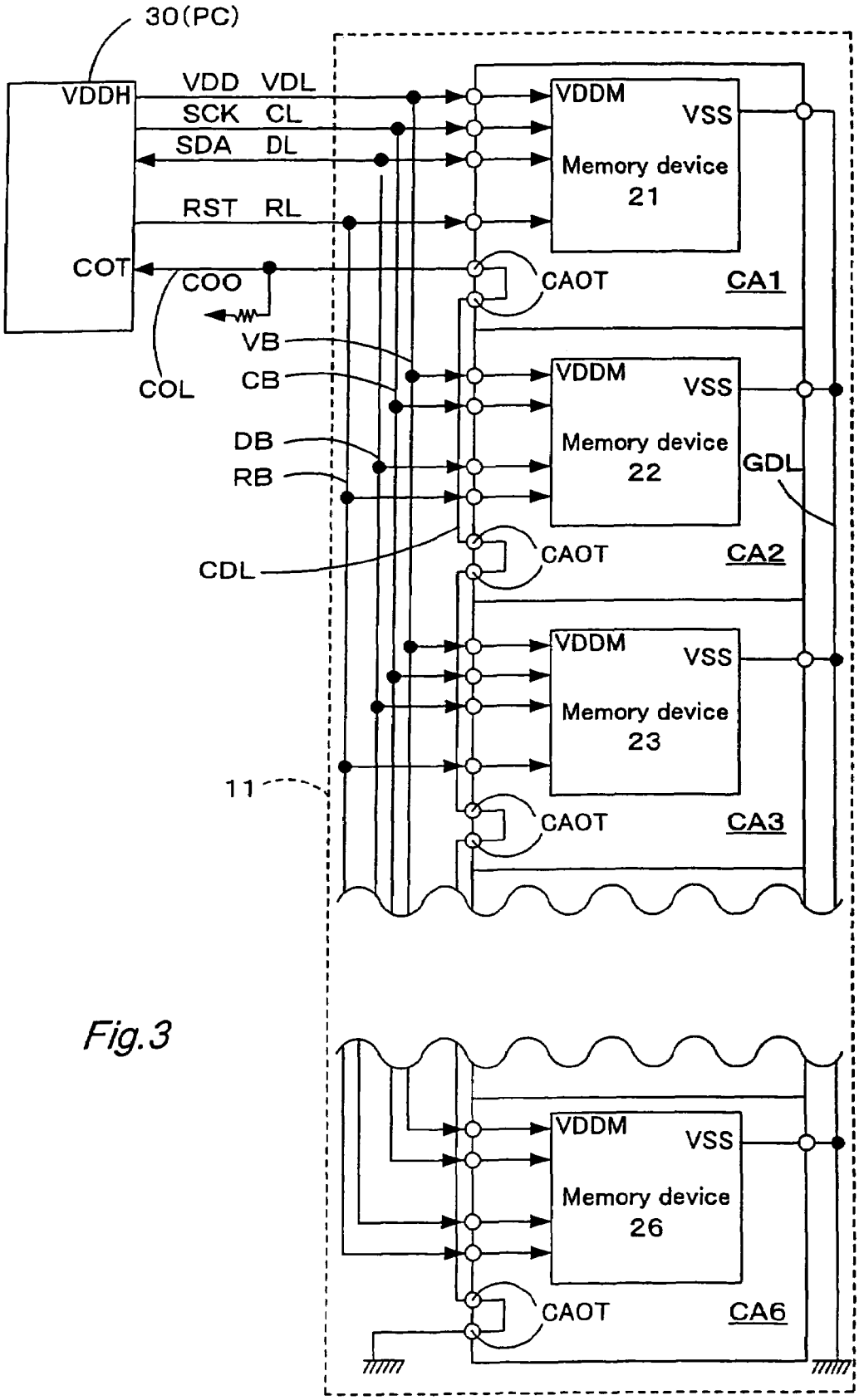
FIG. 3 is a block diagram showing the connection status between each of the memory devices 21 through 26 with which ink cartridges CA1 through CA6 are equipped and control circuit 30 (personal computer PC).

Next, the connection status between memory devices with which in cartridges are equipped and control circuit 30 (personal computer PC) is described with reference to FIG. 2 and FIG. 3. FIG. 2 is a descriptive diagram showing, in summary form, the state of the connection between in cartridges CA1 through CA2 attached on carriage 11 and the control circuit. FIG. 3 is a block diagram showing the state of the connection between each of the memory devices 21 through 26 with which the ink cartridges CA1 through CA6 are equipped and the control circuit 30 (personal computer PC). For ease of description in FIG. 3, cartridges CA1, CA2, CA3, and CA6 equipped with memory devices 21, 22, 23, and 26 are shown as representatives of the implementation. Further, the composition of the print recording material reservoir malfunction detecting device of the present embodiment is not limited to the composition shown in FIG. 3.

Each of the memory devices 21 through 26 is provided on an ink cartridge CA1 through CA6 with one of the six colors for inkjet printing. Moreover, in the present embodiment, EEPROM is used for the memory devices; EEPROM preserves the memory contents inerasably, and allows for rewriting of the memory contents. Each of the memory devices 21 through 26 is equipped with a memory array that stores identifying information; an ID comparator that compares the identifying information that is transmitted with the identifying information stored in the memory array; an operation decoder that analyzes instruction codes; an address counter that counts up the address positions; and an I/O controller or the like that controls the reading and writing into and out of the memory array.

The identifying information stored in the memory array of each of the memory devices 21 through 26 is identifying information for identifying the ink color contained in the respective ink cartridges CA1 through CA6. When identifying information is transmitted from control circuit 30, each of the memory devices 21 through 26 performs a comparison analysis on the individual identifying information and the identifying information that has been transmitted; when the analyzed identifying information is identical to the identifying information stored in the memory array, a return signal is sent to control circuit 30 permitting access. In this manner, control circuit 30 can selectively access the desired ink cartridge CA1 through CA6. Further, when identifying information is transmitted as a data line along with writing data, after the identicality of the identifying information is confirmed, the writing data will be permitted to be written.

The data signal terminals DT, clock signal terminals CT, and reset signal terminals RT of each of the memory devices 21 through 26 is connected respectively to a data bus DB, clock bus CB, and reset bus RB. Control circuit 30 is equipped with buffer memory that temporarily stores a data line in order to transmit to a data signal line DL. The signal line, for example, can be a flexible feed cable (FFC).

The power supply positive terminals VDDH of control circuit 30 are connected to the power supply positive terminals VDDM of each of the memory devices 21 through 26 via power supply lines VDL. Further, the power supply negative terminals VSS of each of the memory devices 21 through 26 are connected to ground line GDL on carriage 11. Cartridge out detecting lines CDL with cartridge out detecting terminals CAOT connected in a cascade and provided on ink cartridges CA1 through CA6 are arranged on carriage 11. One terminal of cartridge out detecting line CDL is grounded, and the other terminal is connected to the cartridge out detecting terminal COT of personal computer PC via cartridge out signal line COL.

With the present embodiment, because a unique ground line GDL is attached to the power supply negative terminal VSS of each of the memory devices 21 through 26, personal computer 26 can access a random memory device 21 through 26 even when not all of the ink cartridges CA1 through 26 are attached. This structure is particularly advantageous when an ink cartridge CA is initially attached, or when a plurality of ink cartridges CA are replaced at one time.

Control circuit 30 is a control device that controls the clock signal generation function, the reset signal generation function, the power supply regulation function, the power supply circuit, the data memory circuit, and each [other] circuit, and controls access to memory devices 21 through 26. Control circuit 30 is arranged on the main body side of color printer 10, and acquires data as to quantity of ink consumed and ink cartridge attachment time and stores these data in the data memory circuit. Further, when the power supply is off, control circuit 30 writes the data as to the quantity of ink consumed and ink cartridge attachment time into the memory devices 21 through 26 via data signal line DL.

Control circuit 30 carries out access with memory devices 21 through 26 when an inkjet printer is turned on, when an ink cartridge is replaced, when a print job is completed, and when an inkjet printer is turned off. Control circuit 30 requests generation of a reset signal RST of the reset signal generating circuit when accessing memory devices 21 through 26. Control circuit 30 transmits identifying information corresponding to ink cartridges CA1 through CA6 sequentially over data signal line DL when the state of communication, and whether ink cartridge CA is attached or not, are detected. In response, when ink cartridge CA to which access is desired is decided, identifying information for ink cartridge CA to which access is desired is transmitted over data signal line DL as a data line stored in a beginning line, and is transmitted to the memory devices 21 through 26 of each ink cartridge CA1 through CA6.

Control circuit 30 controls the power supply circuit and controls the output of the positive power supply. The control circuit 30 of the present embodiment does not normally supply power to memory devices 21 through 26, but supplies a positive power supply to memory devices 21 through 26 only when an access demand is generated with respect to memory devices 21 through 26.

Figure 4:
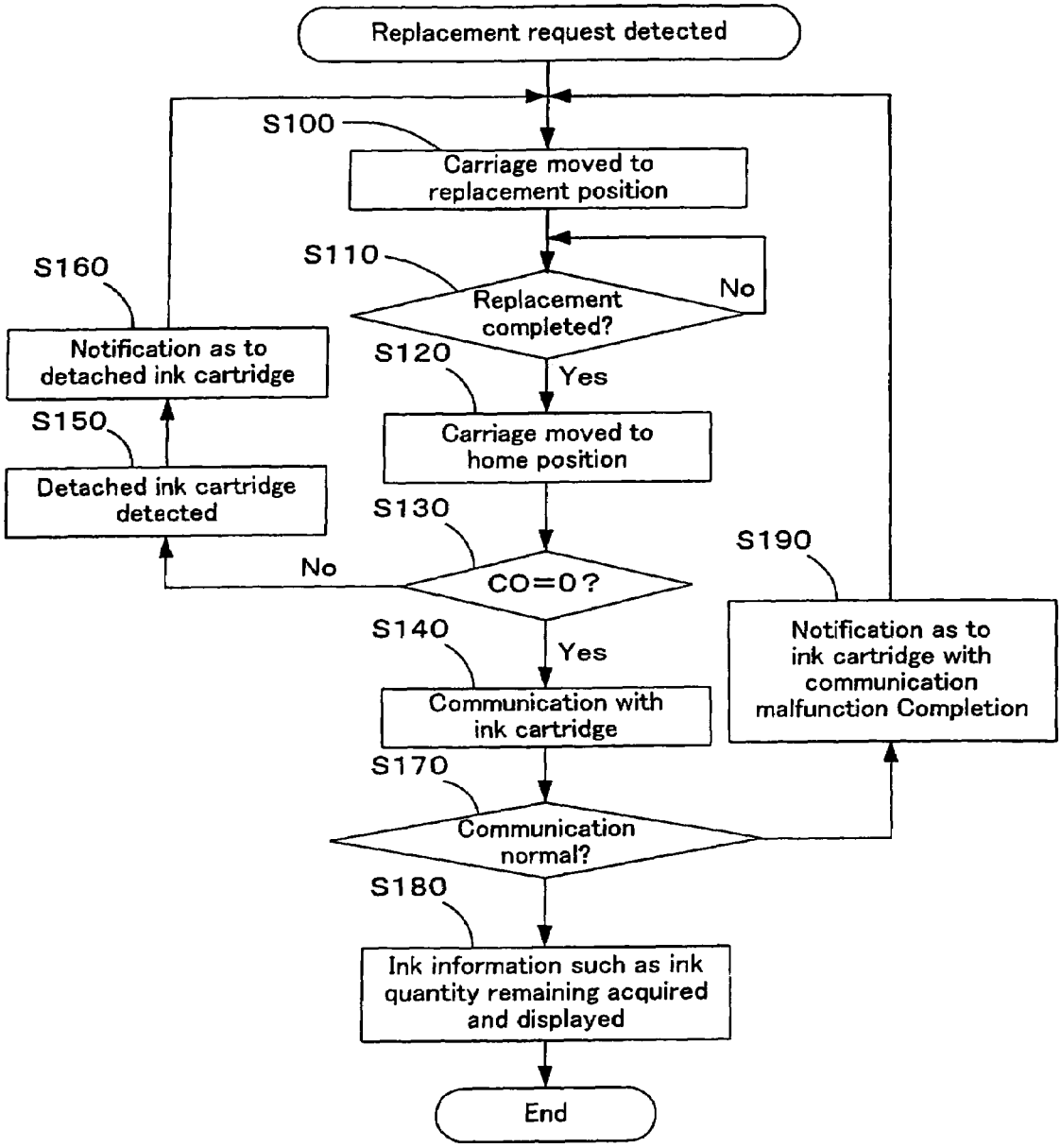
FIG. 4 is a flow chart showing the operation routine carried out by the print recording material reservoir malfunction detecting device of the present embodiment, that is, by control circuit 30.
Figure 5:
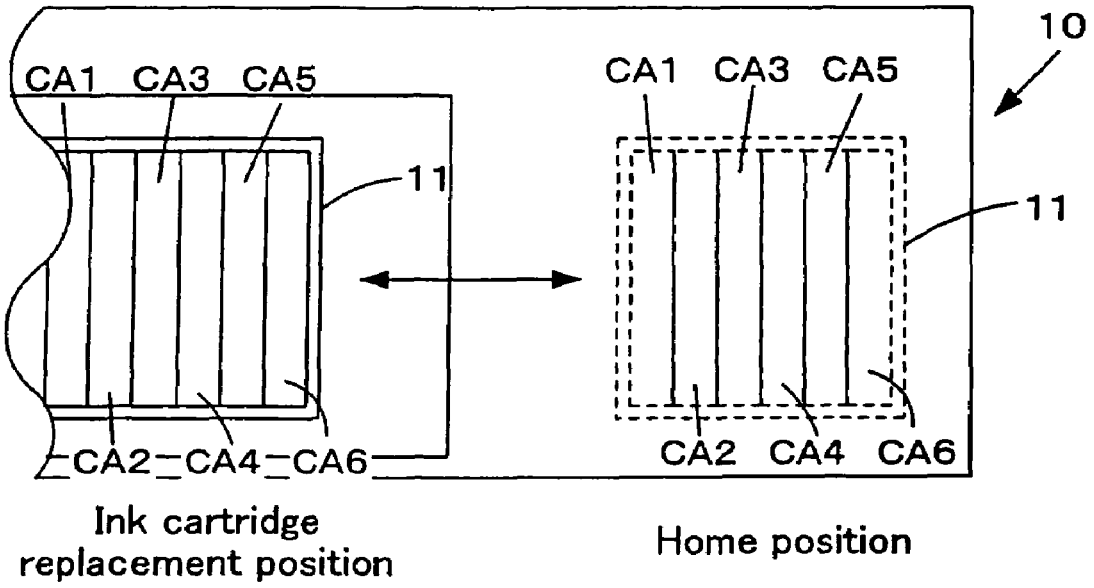
FIG. 5 is a descriptive diagram showing operation of carriage 11 during detection of a print recording material reservoir according to the present embodiment.

The operation of the print recording material reservoir malfunction detecting device of the present embodiment is explained with reference made to FIG. 4 and FIG. 5. FIG. 4 is a flow chart showing the print recording material reservoir malfunction detecting device of the present embodiment, that is, the operation routing performed by control circuit 30. FIG. 5 is an explanatory diagram showing the operation of carriage 11 during detection of a print recording material reservoir.

CPU 31 of control circuit 30 begins the main operation routine when a replacement request is detected for ink cartridge CA. A replacement request for ink cartridge CA may occur, for example, when printing operations are not occurring, by the pressing of an ink replacement button on operating panel 35 of printer 10. An ink replacement button may be provided for each ink cartridge CA, or there may be only one such button. In the printer 10 of the present embodiment, when printing operations are not occurring ink cartridges CA1 through CA6 are hidden in the home position within the main body cover.

Control circuit 30 moves carriage 11 into the ink cartridge replacement position from the home position within the main body cover via carriage motor 12 (step S100). For the ink cartridge replacement position, it is acceptable for only the ink cartridge CA corresponding to the depressed ink replacement button to be replaceable when a separate replacement button is provided for each ink cartridge. Alternatively, it is also possible for all of the ink cartridges CA to be replaceable when only one ink replacement button is provided.

As shown in FIG. 2, control circuit 30 moves carriage 11 into the home position via carriage motor 12 (step S120) when replacement completion is awaited (step S110: NO), and replacement completion is detected (step S110: YES). Replacement completion is detected when an ink replacement button is depressed again.

Control circuit 30 determines whether or not the input value CO of cartridge out signal line COL is equal to zero (CO=0), in order to determine whether or not all of the ink cartridges CA1 through CA6 are attached on carriage 11 in the home position. When all of the ink cartridges CA1 through CA6 are correctly attached to carriage 11, the input value CO of cartridge out signal line COL shows the ground voltage (for example, approximately 0 volts) because the power supply negative electrode signal line VSL is connected serially and grounded. In contrast, if even one ink cartridge is not correctly attached to carriage 11, the value corresponding to the circuit voltage of the control circuit will appear on the cartridge out signal line COL because the power supply negative electrode signal line VSL will not be connected serially and will not be grounded. However, with the present embodiment, in order to prevent the effect of noise or the like, the fixed threshold value is split into two baseline values. Accordingly, an input value CO of 0 or 1 is obtained for cartridge out signal line COL, and whether or not all of the ink cartridges CA1 through CA6 are attached to carriage 11, is determined according to whether or not the input value CO is 0 for cartridge out signal line COL.

When it has been determined that all of the ink cartridges CA1 through CA6 are attached, that is, that the input value CO is 0 (step S130: YES), control circuit 30 carries out communication with memory devices 21 through 26 with which all of the ink cartridges CA1 through CA6 are equipped (step S140).

On the other hand, when it has been determined that one of the ink cartridges CA is not attached, then CO is not 0, that is, the input value is 1 (step S130: NO), the missing ink cartridge, that is, the one that is not attached, is detected (step S150). When the ink cartridge CA that is not attached is detected, control circuit 30 transmits identifying information apportioned among each of memory devices 21 through 26 sequentially through data signal line DL. When the transmitted identifying information is identical to the individually stored identifying information, the memory devices 21 through 26 in the present embodiment return a reply signal to control circuit 30; as a result control circuit 30 detects an ink cartridge CA equipped with a memory device that does not produce a reply signal as an ink cartridge that is not attached.

Control circuit 30 provides notification of an ink cartridge CA that is not attached when an in cartridge CA that is not attached is detected (step S 160). As the notification mode, for example when a printing operation is carried out via personal computer PC, the ink cartridge CA that is not attached may be displayed in a status window for the ink cartridge CA displayed on the display monitor MN, and a warning may be written to warn of the fact that an ink cartridge is not attached. Alternatively, it is also acceptable to provide notification by illuminating a display lamp 351 provided on the operating panel 35 of printer 10 corresponding to each ink cartridge.

Control circuit 30, after providing notification of the fact that an ink cartridge CA is not attached, in order to prompt for attachment of the ink cartridge CA that is not attached, moves carriage 11 into the ink replacement position, and repeats the operations described above (steps S100 through S130). Control circuit 30 carries out communication with each of the memory devices 21 through 26 with which the ink cartridges CA1 through CA6 are equipped when it is confirmed that all of the ink cartridges are attached (step S140).

Control circuit 30 determines whether or not communication can be carried out correctly with all of the memory devices 21 through 26 (step S170). With communication carried out by control circuit 30, the identifying information apportioned among each of the memory devices 21 through 26 is sequentially transmitted to data signal line DL. When the transmitted identifying information is identical to the individually stored identifying information, the memory devices 21 through 26 in the present embodiment return a reply signal to control circuit 30; as a result control circuit determines whether or not communication with each of memory devices 21 through 26 has been carried out normally using the presence or absence of a reply signal, that is, the identifying information.

When it has been determined that communication has been carried out normally (step S170: YES), control circuit 30 acquires information relating to the ink, such as the quantity of ink remaining (or the quantity of ink consumed) from each of memory devices 21 through 26 (step S180), and ends the main operating routine.

On the other hand, when it has been determined that communication has not been carried out normally (step S170: NO), control circuit 30 provides notification of an ink cartridge equipped with a memory device that stores identifying information that has not provided a reply signal as an ink cartridge for which there is a communications malfunction (step S190). The notification mode is carried out in the same manner as notification of an ink cartridge that is not attached. Control circuit 30, in order to prompt for replacement of the ink cartridge CA for which there is a communications malfunction, moves carriage 11 into the ink replacement position, and repeats the operations described above (steps S100 through S170) until communication is carried out normally.

With the print recording material reservoir malfunction detecting device as explained above, when all of the ink cartridges CA are not attached after completion of ink replacement, communication is carried out with all of the memory devices 21 through 26 (ink cartridges CA1 through CA6), and identification and notification can be made as to an ink cartridge that is not attached. Moreover, when one of the ink cartridges CA is not attached, re-attachment of the ink cartridge can be prompted. Accordingly, when ink is replaced, even attachment of a new ink cartridge CA is mistakenly forgotten, the user can easily learn which ink cartridge he or she has forgotten to attached, and can attach an ink cartridge CA without carrying out ink replacement operations again.

Further, even when all of the ink cartridges CA1 through CA6 are attached, communication is carried out with each of the memory devices 21 through 26 of the ink cartridges CA1 through CA6, and an ink cartridge CA equipped with an memory device with which communication cannot be carried out can be identified, and notification provided as to it. Further, when a communication malfunction has developed between the memory device of one of the ink cartridges CA and control circuit 30, replacement can be prompted for the ink cartridge in which the communication malfunction is occurring. A communication malfunction between memory devices 21 through 26 and control circuit 30 cannot be distinguished at a glance; ordinarily, in order to determine which memory device has a communication malfunction it is necessary to replace all of the ink cartridges CA1 through CA6 and make a determination as to each one. In contrast, with the present embodiment, the user can learn at a glance which of the ink cartridges CA1 through CA6 has a communications malfunction.

Further, with the present embodiment, control circuit 30 carries out communications with the memory devices 21 through 26 of ink cartridges CA1 through CA6 in the home position. Accordingly, it is possible to prevent the user from removing ink cartridges CA1 through CA6 during communications, and to carry out communications always in the same state, as a result of which wide variations in the communications result can be prevented. Consequently, identification of ink cartridges CA1 through CA6 that are not attached, and identification (detection) of memory devices 21 through 26 of ink cartridges CA1 through CA6 in which a communication malfunction is occurring can be achieved with more certainty.

The present embodiment described above can of course be used when a single ink cartridge CA is to be replaced, but can also be used when two or more ink cartridges CA are to be replaced. That is, even when two or more ink cartridges CA are not attached, by carrying out communications with memory devices 21 through 26 of ink cartridges CA1 through CA6, the ink cartridges CA that are not attached can be identified.

A print recording material reservoir malfunction detecting device of the present invention is described above with reference to the present embodiment; however, the embodied mode of the invention described above is no more than a means to easily realize the present invention, and does not limit the present invention. The present invention naturally comprises as many changes and modifications with the same effect without departing from the spirit of the present invention and the scope of the claims.

In the embodiment described above, an explanation was given using an EEPROM for memory devices 21 through 26, but the present invention is not limited to use of an EEPROM, but the memory devices can be any device such that stored data is maintained inerasably and can be re-written.

In the embodiment described above, identification of ink cartridges CA1 through CA6 is carried out by memory devices 21 through 26 responding with a reply signal to identifying information transmitted from control circuit 30, but a control circuit 30 can also be used to determine whether or not the desired ink cartridge CA1 through CA6 is identified by reading identifying information stored in each of the memory devices 21 through 26.

In the embodiment described above, a description has been given largely with printer 10 connected to personal computer PC, but it should go without saying that the present embodiment can also be used with a stand alone-type printer. In such a case, notification that an ink cartridge CA is not attached, and notification of a communication malfunction, can be carried out via a display lamp on the operating panel or, if an image display is provided, on the image display.

In the embodiment described above, notification that an ink cartridge CA is not attached, and notification of a communication malfunction, are carried out via a display lamp 351 on operating panel 35 or via a display monitor MN, but these notifications can also be carried out in other ways, including an audio notification from personal computer PC or the printer.

In the embodiment described above, a description is given for the case in which independent ink cartridges are equipped with six memory devices 21 through 26, but the memory devices for the present embodiment may also be used appropriately for ink cartridges of 2 to 5 colors, or 7 or more colors.

What is claimed is:

1. A method of communicating with a plurality of print recording material reservoirs being equipped with memory devices, wherein the print recording material reservoirs are detachably mounted on a printer, and wherein terminals of the memory devices are connected to terminals of the printer when the print recording material reservoirs are mounted on the printer, the method comprising:

determining whether all of the plurality of print recording material reservoirs are attached;

determining whether communication is possible with each of the memory devices via signal lines, when 1) all of the plurality of print recording material reservoirs are determined to be attached, and 2) the plurality of print recording material reservoirs cannot be removed from the printer; and identifying a print recording material reservoir with a communication malfunction, when determining that communication is not possible with any one of the memory devices.

* * * * *